US006666645B1

(12) United States Patent
Arilla et al.

(10) Patent No.: US 6,666,645 B1
(45) Date of Patent: Dec. 23, 2003

(54) ARRANGEMENT FOR ADJUSTING THE DIAMETER OF A GAS TURBINE STATOR

(75) Inventors: Jean-Baptiste Arilla, Soisy sur Seine (FR); Anne-Marie Arraitz, Nandy (FR); Alain Dominique Gendraud, Vernou-la-Celle sur Seine (FR)

(73) Assignee: Snecma Moteurs, Paris (FR)

( * ) Notice: Subject to any disclaimer, the term of this patent is extended or adjusted under 35 U.S.C. 154(b) by 99 days.

(21) Appl. No.: 09/926,122

(22) PCT Filed: Jan. 12, 2001

(86) PCT No.: PCT/FR01/00101

§ 371 (c)(1),
(2), (4) Date: Sep. 6, 2001

(87) PCT Pub. No.: WO01/51771

PCT Pub. Date: Jul. 19, 2001

(30) Foreign Application Priority Data

Jan. 13, 2000 (FR) ..... 0000371

(51) Int. Cl.[7] ..... F01D 11/24
(52) U.S. Cl. ..... 415/116; 415/173.1
(58) Field of Search ..... 415/115, 116, 415/173.1, 173.2, 173.3, 176, 173.4, 173.5

(56) References Cited

U.S. PATENT DOCUMENTS 4,177,004 A 12/1979 Riedmiller et al.
4,573,866 A 3/1986 Sandy, Jr. et al.

FOREIGN PATENT DOCUMENTS

FR 1 604 778 1/1972
WO WO 94/12775 6/1994

*Primary Examiner*—Edward K. Look
*Assistant Examiner*—Kinya N McCoy
(74) *Attorney, Agent, or Firm*—Oblon, Spivak, McClelland, Maier & Neustadt, P.C.

(57) ABSTRACT

An arrangement for adjusting the diameter of a gas turbine stator includes a casing having a main portion and rings bordering a vein of a gas flow and located in front of respective levels of mobile blades of a rotor, and communication passages of a gas flow under pressure. The rings are surrounded by the casing and fixed thereto by circular groups of spacers. The rings include a wall extending from the casing to one of the rings and separating two chambers. The wall includes an outside edge curved into a spacer hook and engaged between the main portion of the casing and a respective appendage curved into a casing hook associated with the spacer hook. The communication passages of the gas flow under pressure exist between the chambers. At least one of the communication passages is realized by cavities through a junction of hooks.

12 Claims, 6 Drawing Sheets

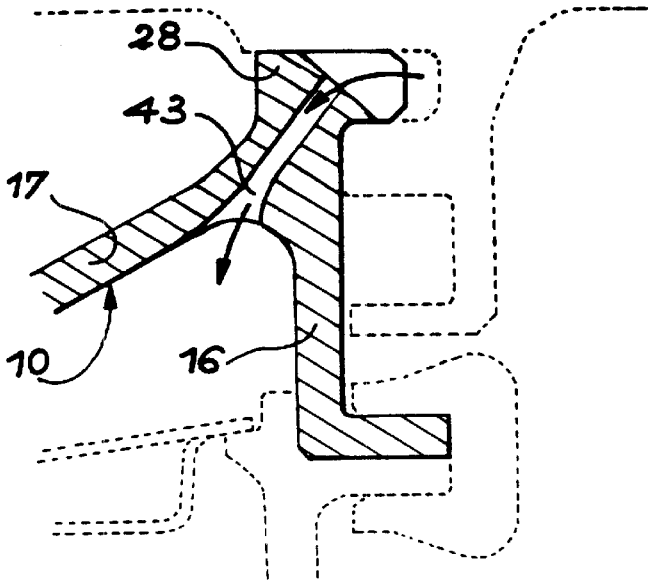
FIG. 6
FIG. 7
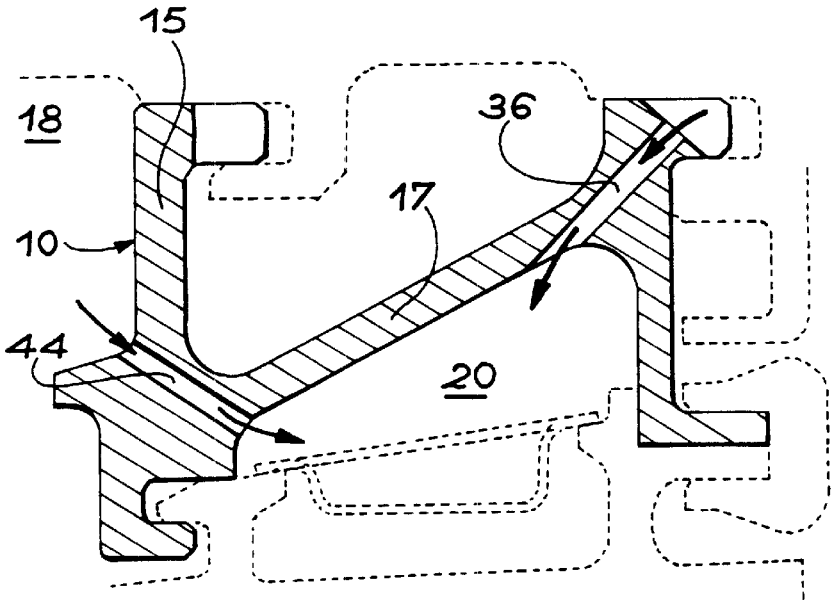

ARRANGEMENT FOR ADJUSTING THE DIAMETER OF A GAS TURBINE STATOR

BACKGROUND OF THE INVENTION

1. Field of the Invention

The present invention is concerned with an arrangement for adjusting the diameter of a gas turbine stator.

2. Description of the Background

Today some gas turbines include adjusting devices to adjust the inside diameter of a stator in order to reduce the existing play between the stator and the mobile ends of rotor blades to the lowest possible value. A frequent device used to provide this diameter adjustment includes taking a portion of fresher gases originating in compressors, conveying the portion through the stator and blowing the portion onto stator driving rings extending in front of rotor blades. This makes it possible to carry out what is referred to as stator ventilation, the diameter of the stator being modified according to the temperature and flow of ventilation gases. Generally, the bleeding of gas is dual: one source known as a hot source with a fixed flow dilates the casing when necessary, while another source known as a cold source with a variable and controlled flow contracts the casing.

The path that the hot source ventilation gases use is a volume internal to the stator between the rings to be ventilated and the casing that surrounds them. Spacers linking the rings to the casing include transverse walls breaking the volume of the path into chambers, and through which it is necessary to create communication to make it possible for the ventilation gases to flow. Numerous examples of such communication means have been suggested in the prior art, but a good ventilation is not easy to ensure because it must be well distributed between successive rings and on the surface of each of these rings, otherwise the differences of ventilation intensity and of thermal dilation around the rings circumference will produce undulations of rings, and thus leave areas of gas escapes at the ends of the rotor blades. Moreover, openings arranged through the spacers weaken the rings, with dangerous consequences for portions of the machine subjected to strong mechanical stress, because stresses are concentrated around these openings.

SUMMARY OF THE INVENTION

The purpose of this invention is thus to suggest a gas turbine stator arrangement, the inside of which is compartmentalized, but provided with openings allowing ventilation gas to be blown onto the rings of the stator subjected to an adjustment. The openings are designed to produce a highly regular ventilation around the rings without exaggeratedly weakening structural elements through which they are drilled.

The present invention in its most general form relates to an arrangement for adjusting the diameter of a gas turbine stator. The stator includes a casing, rings bordering a vein of flowing gases and located in front of respective levels of mobile blades of a rotor, the rings being surrounded by the casing and fixed to the casing by circular spacers. Each ring includes a transversal wall extending from the casing to one of the rings and separating two chambers. The wall includes an outside edge curved into a spacer hook and engaged between a main portion of the casing and a respective appendage curved into a casing hook associated with the spacer hook. Communication paths of gas under pressure exist between chambers. At least one of the communication passages is carried out by cavities provided through a junction of hooks made up of one spacer hook and the casing hook with which it is associated.

Because spacer hooks and casing hooks are appendages or ends of these structures, they are subjected to moderate stress and the creation of openings through them produce acceptable levels of stress. Preferably, the communication means between chambers suggested herein include longitudinal notches cut through each spacer hook, a circular space located under the respective casing hook and outside the spacer hook, and radial notches made into the spacer hook between the longitudinal notches and the opening in the aforesaid chambers.

Two main designs of this arrangement are suggested: either radial notches are sufficiently deep to extend beyond the hook of the casing, or they include collecting portions followed by drillings; this last fitting lends itself readily to a calibration of the flow of ventilation (according to the intake section of the radial notches or drillings) and to the calming of gas in the chamber downstream from the flow (after passing through the tightened portion of drillings).

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 4–9 are cross sectional views of different portions of the stator illustrating ways of creating drillings supplementing or facilitating ventilation.

DESCRIPTION OF THE PREFERRED EMBODIMENT

Figure 1:
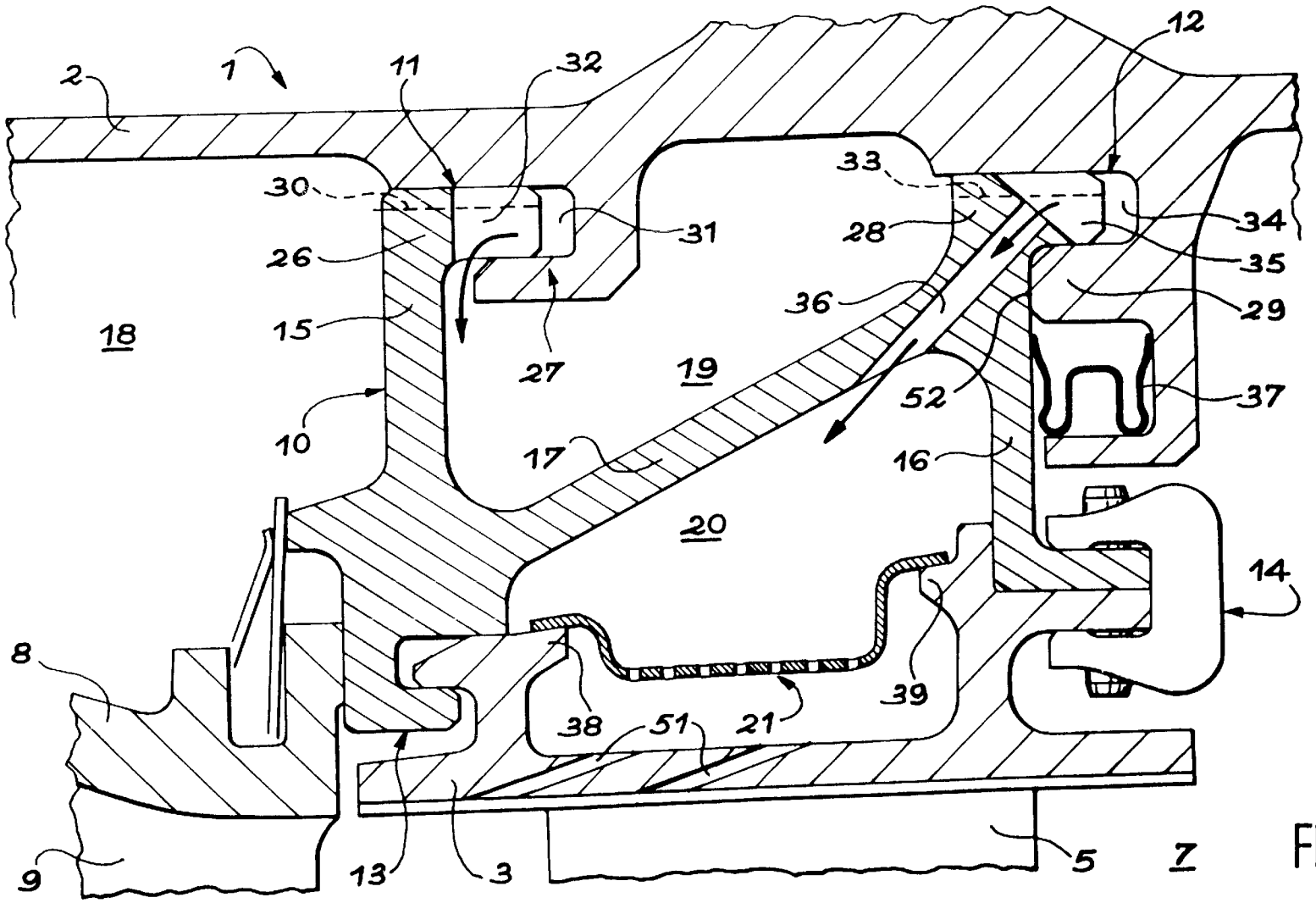
FIG. 1 is a cross sectional view of a fragment of a stator illustrating a spacer equipped with the invention and its parings.
Figure 2:
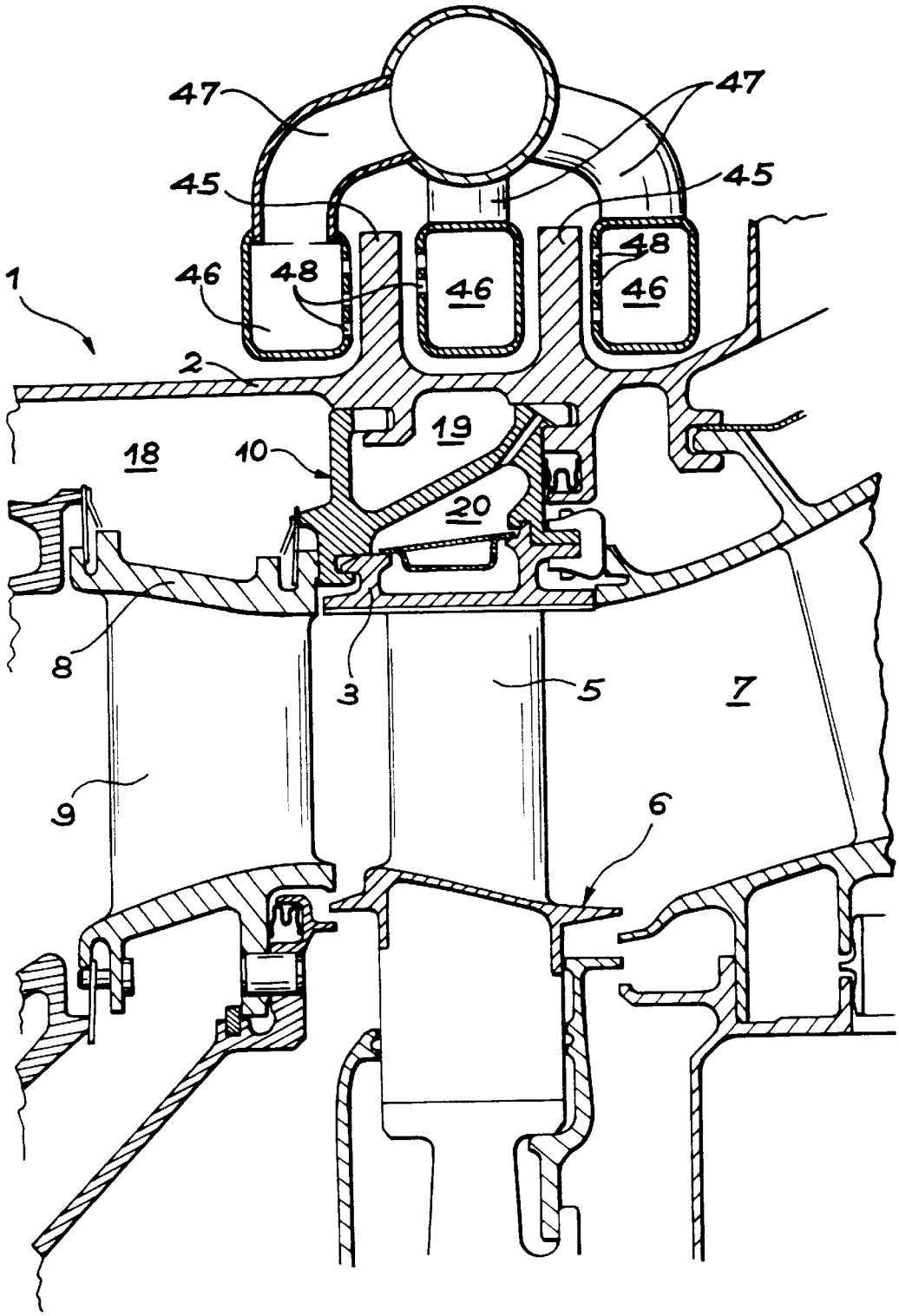
FIG. 2 is a cross sectional view of the stator illustrating the presence of a second air ventilation system, optional, with the same embodiment of ventilation spacer.

FIG. 1 illustrates a fragment of a stator 1 of a gas turbine including some surrounding elements of FIG. 2. Stator 1 includes a casing 2 outside, surrounding rings 3 coming opposite levels of mobile blades 5 of a rotor 6 within a vein 7 of gas flow, and rings 3 alternate with other rings 8 supporting fixed blades 9 along vein 7. Gas turbines include several successive rings 3 and 8, but only one of each kind is illustrated on the fragment of FIGS. 1 and 2, the invention being applied here only to a ring 3.

Spacers 10 link rings 3 to casing 2. Junctions 11, 12, 13 and 14 are generally made up of an assembly of a pair of hooks and link spacer 10 to stator 1 at the front and at the back. To reduce the play between rings 3 and mobile blades 5 during the operation of the gas turbine, fresher gases originating in a compressor upstream of a gas turbine are tapped to be blown outside of rings 3 and onto the face opposite mobile blades 5. Spacer 10 includes a transverse wall 15 at the front between junctions 11 and 13, a transverse wall 16 at the back between junctions 12 and 14, and an intermediate transversal wall 17 connecting both the preceding ones and laid out obliquely and appreciably between junctions 13 and 12. Accordingly, ventilation gases passing through casing 2, but around rings 3 and 8, pass initially through a first chamber 18 at the front of wall 15, then through an intermediate chamber 19 between wall 15 and intermediate wall 17, and finally through a downstream chamber 20 between the intermediate wall 17 and rings 3. Downstream chamber 20 is delimited by rear wall 16 and is divided by a lid provided with drillings, or more generally one box 21 made up of several of these lids, already described in the prior art as contributing to the equalization of ventilation (for example in U.S. Pat. No. 5,273,396). The rear wall 16 is a wall external to the ventilation chambers 18, 19 and 20, because the flow of ventilation stops there and another atmosphere starts from there.

Communications allowing gases from a compressor to flow through chambers 18, 19 then 20 include openings arranged mainly through junctions 11 and 12 to casing 2. The next description below shall be read with reference to FIG. 3.

Junction 11 is made up of an edge of the front of wall 15, curved downstream (or rear) to form a spacer hook 26, and one appendage associated with casing 2, the end of which is curved upstream (or towards the front) to give one casing hook 27. In a similar way, rear and intermediate walls 16 and 17 end onto a common facing backwards, forming another spacer hook 28, whereas an appendage associated with casing 2 is also bent forwards to form another casing hook 29. Spacer hooks 26 and 28 are inserted between casing 2 outside and respective of casing hooks 27 and 29 inside.

Figure 3:
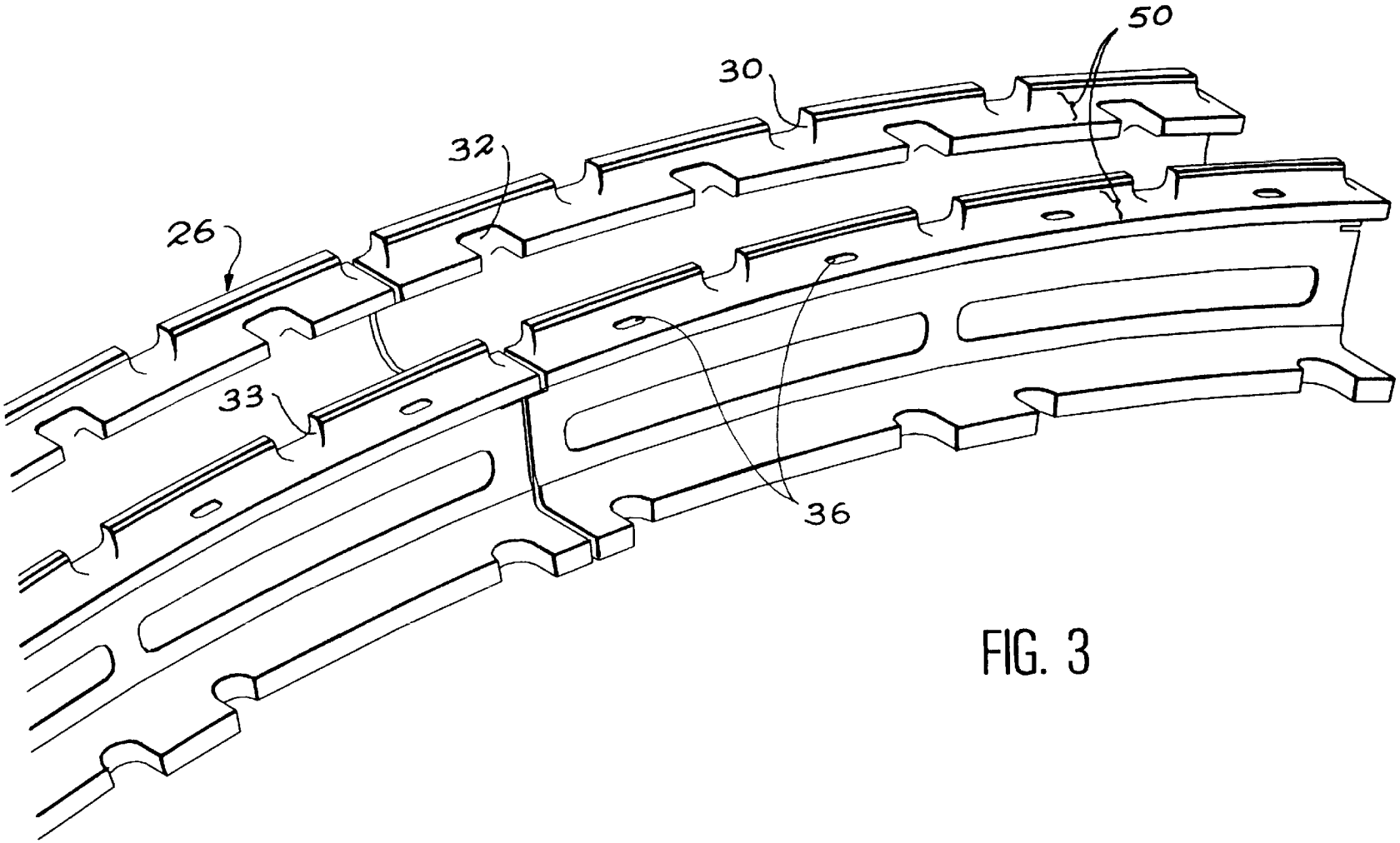
FIG. 3 is a three dimensional plan view of a portion of the stator illustrating spacer hooks.

Spacer hook 26 located at the front is not a continuous or intact structure, but rather has longitudinal and parallel notches 30 regularly distributed over its circumference, cutting it straight through its outside face and thus extending from the upstream chamber 18 to the annular space 31 ranging between the end of spacer hook 26 and the bottom of casing hook 27. Spacer hook 26 is also notched with parallel radial notches 32, and regularly distributed over the circumference of spacer hook 26 at a middle distance of longitudinal notches 30, and radial notches 32 have a sufficient depth to extend beyond the end of casing hook 27. The spaces 31 and 34 arranged between the ends of spacer hooks 26 and 28 and the bottom of the casing hooks 27 and 29 will be improved if their meridian section is increased by providing rabbets 50 (as shown in FIG. 3) on external faces of the spacer hooks 26 and 28, on the side of the casing hooks 27 and 29 and by extending longitudinal notches 30 and 33. Rabbets 50 have several advantages including: the reduction of contact surface between the spacer and casing, hence reducing casing overheating due to conduction; better control of flow section of the air circulating in circumference because manufacturing dispersions are lower for rabbets 50 than for the bottom of the groove of the casing hooks; better control of peripheral speed of air flow and convective exchange coefficients; and greater convective heat-transferring surface on casing 1 and thus better control over the flow of heat and its homogeneity.

Heat exchanges are produced in spaces 31 and 34. They are regulated by the surface casing 1 wet by gas of; the speed of air flow in circumferential direction; the number of longitudinal notches 30 and 33, and therefore the length of circumferential paths.

A communication between chamber 18 and 19 is thus established, the ventilation gases flowing through longitudinal notches 30, then through the space 31 where they disperse and finally through radial notches 32.

Notches 30 and 32 that weaken structures and concentrate stress are established only on the hooks of junction 11, i.e. on portions of edges not likely to produce high stress concentration. The movement of dispersion of the flow through space 31 contributes to regulate the flow of gas on the circumference of the machine, and thus the ventilation effect. The changes of direction to which the flow is subjected result in loss of load beneficial to the effectiveness of ventilation. Finally, gases are discharged in centripetal direction, towards rings 3.

It should be obvious at this point that notches are cut only through the spacer hook 26, but similar suitable results would most probably be obtained if radial notches had been made into the casing hook 27.

A similar provision makes it possible to establish communication between chambers 19 and 20. Longitudinal notches 33 similar to notches 30 of hook 26 are initially cut into the spacer hook 28 located at the back, and a space 34 similar to the space between the end of the spacer hook 28 and the bottom of the casing hook 29 is provided; ventilation gases discharge in this space 34 towards radial notches 35 made in between longitudinal notches 33. However, the ventilation gases do not communicate directly with the downstream chamber 20, but instead with drillings 36 in a variable number for each radial notch 35. Drillings 36 extend towards chamber 20 by going through the material of spacer 10 at the junction of walls 16 and 17. This arrangement offers the same characteristics and advantages as those of the assembly at junction 11, and drillings 36 are directed obliquely with a strong centripetal component directing ventilation gases as required towards rings 3. Notches 33 can still open into rabbets 50, which prolong them towards space 34. Gases ventilate onto rings 3 with an even greater regularity through box 21 before discharging the gases through escapes of the structure and outlet channels 51 provided through the skin of rings 3, and into vein 7. The stop created by the end of casing hook 29 located behind and against the rear wall 16 ensures there will be spaces established in spaces 31 and 34, and the ring 8 located immediately upstream reinforces this push by pressing against the front wall 15 at the outside front of junction 13. A joint 37 placed in a groove of the hook 29 and compressed by the rear wall 16 ensures the downstream sealing of junction 12; the section of joint 37 is made up of three lobes placed in a row and for this reason joint 37 is called an omega joint. The sealing between adjacent joint 37 and the hook 29 is doubled by the plane push 52 of the casing hook 29 against rear wall 16, forming one line of uninterrupted sealing. Radial notches 35, drillings 36, 42 and 43 are designed such that they do not interrupt this line of sealing while making space 34 to communicate with the chamber of joint 37.

Figure 8:
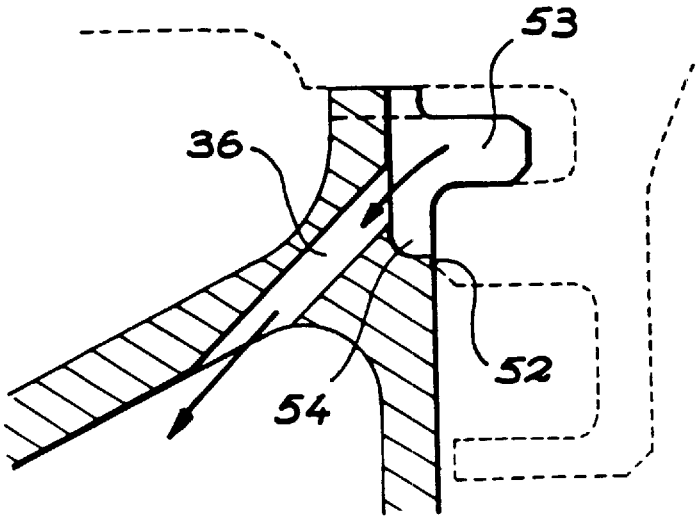
Figure 9:
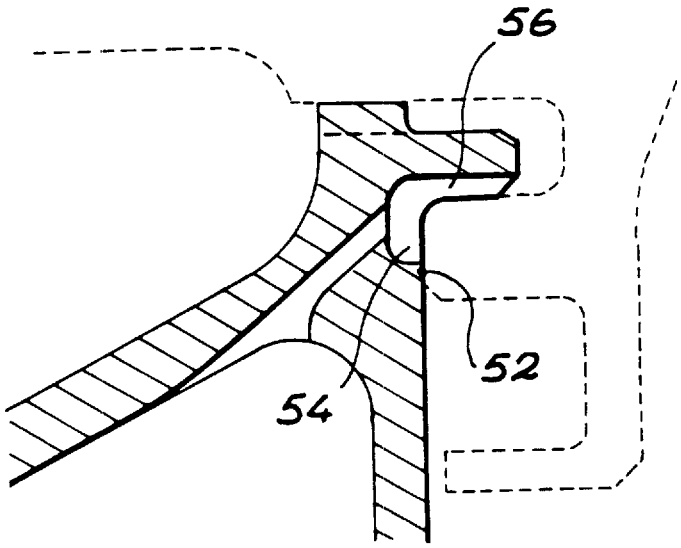

Arrangements of FIGS. 8 and 9 allow for the same result. As shown in FIG. 8, radial notches 53 (instead of 35) extend in spot-facing on a portion 54 of the rear wall 16 to provide access to drillings 36, while reducing the width of the plane push 52, but without removing it. As shown in FIG. 9, notches 55 (instead of 35 or 53) extend only in the inside face of spacer hook 28, in front of casing hook 29, thus lengthening a gases path in the cavities of radial notches 34. Other fittings are also possible. The hollow portion 54 of rear wall 16 facilitates air intake into the drillings.

Figure 4:
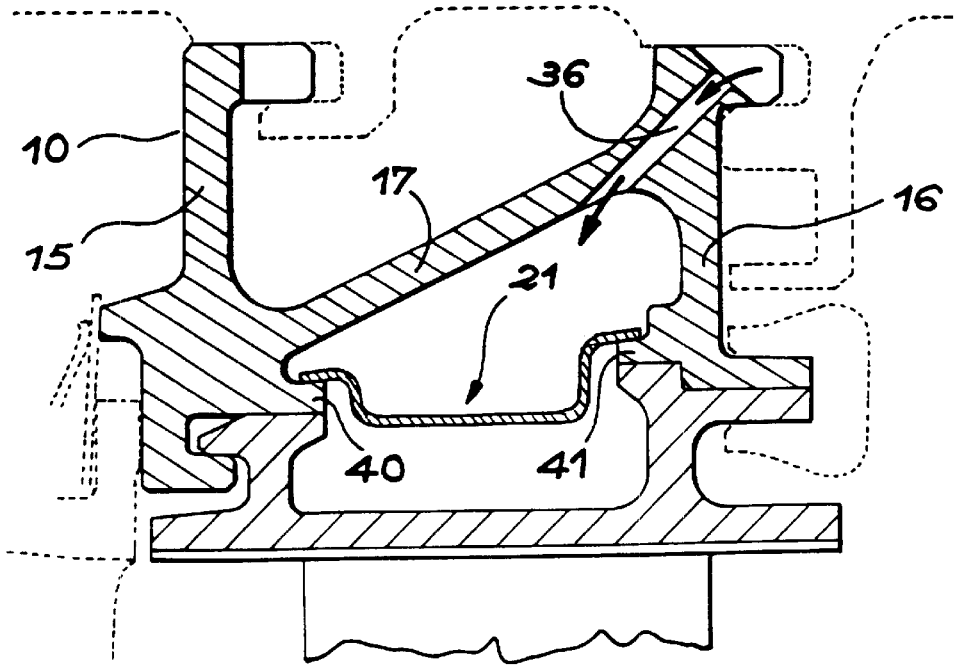

Box 21 can be a simple impact sheet with multiple drillings and can be fixed either to the ring or to the spacer. Box 21 is hung to edges 38 and 39 of rings 3. The favorable direction of ventilation gases would allow bringing box 21 closer to gases intake in chamber 20, by having it supported by edges 40 and 41 of spacer 10 located on walls 15 and 16, as shown in FIG. 4.

Figure 5:
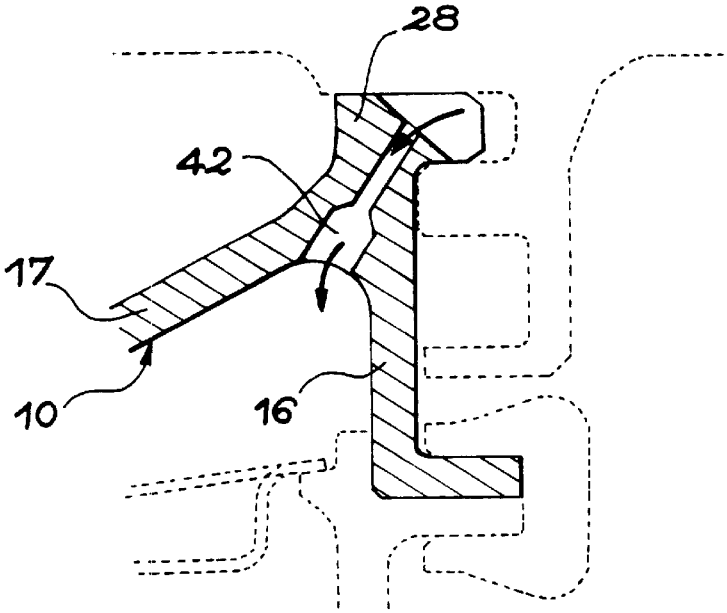

Drillings 36 have a constant section, but may be replaced by divergent drillings with the section increasing towards the downstream chamber 20, such as a staged drilling 42 with sudden variation of diameter, as shown in FIG. 5, or nozzle drilling 43 with progressive variation of diameter, as shown in FIG. 6. Drillings 42 and 43 would be located like drilling 36, but the size of intake and outlet diameters would make it possible to act at the same time on the calibration of ventilation gas intake (thanks to the smaller intake diameter) and upon the quietness effect produced in chamber 20 intake (thanks to the larger outlet diameter), which would improve the supply of box 21.

This invention may also be combined with more traditional communication means between chambers, such as drillings 44 of FIG. 7 provided between chamber 18 and chamber 20 through the material of spacer 10 laid out at the junction of transverse walls 15 and 17; the invention would then make it possible to mitigate the weakening mechanical effect produced by drillings 44, while reducing their required number.

From FIG. 2, it can seen that stator I may be equipped with external ribs 45 in front or between which distribution chambers 46 of another gas ventilation network forming a cold source are laid out, these distribution chambers 46 being connected to supply pipes 47 used for the circulation of gases. Distribution chambers 46 have blowing holes in front of ribs 45 for the gas to reach them. Often, a second ventilation gas flow will be tapped from a portion of a compressor located further upstream from the first flow portion, so that the gas of this second flow will be fresher. The adjustment of the rings 3 diameter will then consist of a combined adjustment of both ventilation flows providing an excellent precision.

What is claimed is:

1. An arrangement for adjusting diameter of a gas turbine stator, comprising:

a casing having a main portion;

a plurality of rings bordering a vein of a gas flow and located in front of respective levels of mobile blades of a rotor, the plurality of rings being surrounded by the casing and being fixed onto the casing by circular groups of spacers each including one or more walls extending from the casing to one of the plurality of rings and separating two chambers, each of the one or more walls including an outside edge curved into a spacer hook and engaged between the main portion of the casing and a respective appendage curved into a casing hook associated with the spacer hook; and a plurality of communication passages of a gas flow under pressure and existing between the two chambers, wherein at least one of the plurality of communication passages is realized by a plurality of cavities provided through a junction of hooks that includes one of the spacer hooks and the associated casing hook.

2. The arrangement according to claim 1, wherein the plurality of communication passages comprises:

a plurality of longitudinal notches cut through one of the spacer hooks;

a circular space located under the associated casing hook and in front of one of the spacer hooks; and a plurality of radial notches made into the spacer hook between the plurality of longitudinal notches and an opening in one of the two chambers.

3. The arrangement according to claim 2, wherein the plurality of radial notches extend beyond the associated casing hook.

4. The arrangement according to claim 2, wherein the plurality of radial notches include collecting portions and at least one drilling.

5. The arrangement according to claim 4, wherein the at least one drilling goes through each of the collecting portions.

6. The arrangement according to claim 4, wherein the at least one drilling has a divergent section starting from the collecting portions.

7. The arrangement according to claim 2, further comprising a plurality of rabbets cut through one of the spacer hooks to prolong the plurality of longitudinal notches.

8. The arrangement according to claim 2, wherein the plurality of radial notches extend on a portion of one of the walls.

9. The arrangement according to claim 1, further comprising a plurality of lids covering each of the plurality of rings drilled to distribute the gas flow under pressure more evenly.

10. The arrangement according to claim 1, further comprising a blowing device of a second gas flow onto an outside rib of the casing, the gas flows being at different temperatures.

11. The arrangement according to claim 1, further comprising at least one drilling going through one of the walls to avoid hollows made through the junction of hooks to provide a direct supply of one of the two chambers.

12. The arrangement according to claim 1, wherein one of the casing hooks is adjacent to a chamber seal and forms a continuous line of sealing with one of the walls of the spacers, the one of the walls being an external wall of the two chambers.

* * * * *